United States Patent [19]

Rooy et al.

[11] Patent Number: 4,902,353

[45] **Date of Patent: * Feb. 20, 1990**

[54] METHOD FOR MAKING LITHOPLATE

[75] Inventors: Elwin L. Rooy; Gerald R. Petrey, both of Pittsburgh, Pa.; James R. Weaver, Bettendorf, Iowa; Douglas A. Granger, Murrysville, Pa.; Raymond T. Richter, Davenport, Iowa; H. Gray Reavis, Jr., Newburgh, Ind.

[73] Assignee: Aluminum Company of America, Pittsburgh, Pa.

[ * ] Notice: The portion of the term of this patent subsequent to Apr. 4, 2006 has been disclaimed.

[21] Appl. No.: 259,738

[22] Filed: Oct. 19, 1988

Related U.S. Application Data

[63] Continuation of Ser. No. 939,318, Dec. 8, 1986.

[51] Int. Cl.[4] ..... C22F 1/04

[52] U.S. Cl. ..... 148/2; 148/11.5 A; 148/439; 148/440

[58] Field of Search ..... 148/2, 11.5 A, 439, 148/440

[56] References Cited

U.S. PATENT DOCUMENTS 4,818,300 4/1989 Rooy et al. ..... 148/2

*Primary Examiner*—R. Dean

*Attorney, Agent, or Firm*—Wegner & Bretschneider

[57] ABSTRACT

An improved method of making a lithoplate from a 5XXX type alloy which includes controlling the composition and casting practices to eliminate forming a pine tree metal structure in an ingot used for rolling a workpiece to be made into lithoplate. The method also includes homogenizing and hot rolling the ingot at a controlled initial temperature to produce a desired grain and metal microstructure in the sheet rolled from the ingot which is suited for providing a surface having substantially uniform and evenly distributed craters produced by an electrochemical method of graining.

9 Claims, 1 Drawing Sheet

METHOD FOR MAKING LITHOPLATE

This application is a continuation of Ser. No. 939,318 filed Dec. 8, 1986 allowed.

BACKGROUND OF THE INVENTION

This invention relates to a method for making an aluminum lithographic plate which is more commonly identified as lithoplate. More particularly, it relates to an improvement in the method of making a workpiece from which an improved lithoplate is made.

Lithography is defined as the process of printing from a plane surface such as a stone or metal plate on which the image to be printed is ink-receptive and the blank area ink-repellant. The stone or metal plate is referred to as lithoplate, but for purposes of discussing this invention and its background, lithoplate will always refer to metal, or more particularly, an aluminum alloy.

The ink-receptive and ink-repellant areas on lithoplate are developed by subjecting the plate to contact with water in the printing press. The image area is hydrophobic or water-repellant, and the non-image area is hydrophilic or water-retentive. The inks used for printing are such that they will not stick or adhere to wet surfaces and, thus, when the lithoplate is contacted with an ink-laden roller, ink is transferred only to the image area.

It is evident that the quality or suitability of a lithoplate for printing is directly related to the hydrophobic and hydrophilic characteristics of the image and non-image areas. It has long been known that uniform roughening of the surface by a process known as graining is advantageous in developing both the hydrophobic and hydrophilic areas. To make the image area a lithoplate workpiece is coated with a hydrophobic light-sensitive material. This material also is resistant to attack or dissolution from acids until it is exposed to light and is commonly called a resist. After the workpiece has been coated with the resist, a negative having the desired image thereon is overlaid on the resist-coated workpiece and exposed to light. In the non-image area, the light causes a reaction in the resist which makes it soluble in acid and, thus, after exposure to light, the plate is contacted with acid to remove the resist in the non-image area. Hydrophobic resist material remains, therefore, only in the image area, and the underlying grained metal surface is advantageous in bonding the resist to it. In the non-image area, with the resist removed, the grained surface is advantageous in enhancing the water retention character of the surface.

Originally, graining of the workpiece was accomplished mechanically by ball graining or brushing. In ball graining, a slurry of steel balls and abrasive material is agitated on the workpiece with the extent of roughening controlled by such things as the type of abrasive, number of balls, speed of agitation, etc. In brush graining, brushes are rotated or oscillated over the surface covered with an abrasive slurry. Mechanical graining usually requires cleaning the plate to make it suitable for further processing. Typically, cleaning is accomplished by immersion in a commercial caustic type solution. It is evident that uniformity and quality of the roughened surface is difficult to control with such methods. In addition, mechanical graining may be relatively slow and costly.

Because of difficulties in mechanical graining, the constant growth of lithographic printing, higher operating speeds of modern printing presses, need for longer lithoplate life, etc., increasing attention has been given to chemical and electrochemical methods of graining. By these methods, the grain is produced by a controlled etching of the surface by the use of chemicals alone or the combination of passing current through a chemical solution. U.S. Pat. Nos. 4,301,229, 4,377,447 and 4,600,482 are cited as examples of many that are directed to electrochemically graining. Whether mechanically grained or electrochemically grained, lithoplate workpieces have certain requirements in common. Lithoplate is used in light gauges, such as 0.008 or 0.012 inch, for example, and by the nature of its use, it must be relatively flat. The surface should be free of imperfections such as deep gouges, scratches and marks which would interfere with the production of a uniform grained surface. From the standpoint of economics or commercial utilization in making aluminum lithoplate, it is desirable that it be produced from an aluminum alloy which can be rolled to the light gauges noted above at reasonable production rates and reasonable levels of recovery or scrap loss. It is also desirable that the alloy from which the lithoplate is made be one which produces reasonably good mechanical properties in the sheet when rolled to finished gauge.

In addition, it has become a common practice to apply an anodized finish to the grained surface, whether mechanically or electrochemically produced. It is desirable, therefore, that the aluminum alloy and fabricating practices used to make lithoplate be such that the sheet responds well to anodizing; that is, be uniform in color and relatively free from streaks.

Heretofore, a number of aluminum alloys have been tried and evaluated for the commercial production of lithoplate to be mechanically grained, and the most widely used alloys today are 3003 and 1100. In consideration of all of the foregoing lithoplate requirements, these alloys have been determined to be the best from the sheet manufacturer and lithoplate maker or user point of view. With respect to electrochemical graining, however, the response of an aluminum alloy to the particular chemicals employed is obviously an important factor, and these alloys are generally not preferred for graining by such methods.

In the past, it has generally been believed that the higher the purity of the aluminum alloy, the more uniform is the response to electrochemical etching. As a consequence, 1050 alloy which has the highest purity of alloys considered to be generally commercial has been evaluated and is generally preferred by lithoplate manufacturers who employ electrochemical graining methods. Since 1050 alloy is at least 99.5% aluminum, a lithoplate produced from this alloy has lower mechanical properties than that produced from either 3003 or 1100 alloy. Although lithoplate users have accepted plates made from this alloy because of its superior response to electrochemical methods of graining, a lithoplate having higher mechanical properties would b preferred.

It would be desirable, therefore, to provide a workpiece fabricated from a single alloy having mechanical properties equivalent to or better than 3003 alloy which would be suitable for graining by either a mechanical or electrochemical method.

SUMMARY OF THE INVENTION

By a method of this invention, an aluminum alloy is cast into an ingot which is scalped, homogenized and preheated before being hot and cold rolled to a relatively thin gauge as a lithoplate workpiece. The workpiece may then be mechanically or electrochemically grained to produce a suitable surface for lithographic printing. If desired, the grained surface may be anodized.

A method of this invention is an improvement over methods known heretofore for making lithoplate by controlling the alloy composition, the speed and temperature of casting the ingot, and the depth of scalping, homogenizing and preheating the ingot prior to hot rolling. Careful control of the foregoing steps are followed by hot rolling the ingot to a suitable reroll gauge and then cold rolling the reroll stock to finish gauge using practices appropriate for producing a lithoplate workpiece. The workpiece thus produced is then grained by a mechanical or electrochemical method to develop a desired grain and the grained surface may then be anodized. A lithoplate produced by a method of this invention which includes anodizing the grained surface has a substantially streak-free surface. Although streaks in the anodized finish usually have no adverse effect on the printing function of the lithoplate, streaks are undesirable from a commercial point of view because many lithoplate users consider the presence of streaks to be an indication of an inferior lithoplate and will not accept a lithoplate unless it has a substantially uniform appearance.

A lithoplate produced by a method of this invention may be provided with a grain which is substantially uniform in depth and color by either mechanically or electrochemically graining. When mechanically grained and cleaned, as has been noted heretofore, a lithoplate produced by a method of this invention has a substantially lighter color than a 3003 lithoplate mechanically grained by the same method.

It is an objective of a method of this invention to make a lithoplate which has a substantially uniform electrochemically grained finish.

It is also an advantage of a method of this invention that a mechanically grained and cleaned lithoplate produced thereby is substantially lighter in color.

It is an advantage of a method of this invention that lithoplate may be produced from a single alloy which is suitable for graining by mechanical or electrochemical methods and has mechanical properties equal to or better than that made from 3003 alloy.

These and other objectives and advantages of this invention will be more apparent with reference to the following description of a preferred embodiment and accompanying drawings.

DESCRIPTION OF A PREFERRED EMBODIMENT

Figure 1:
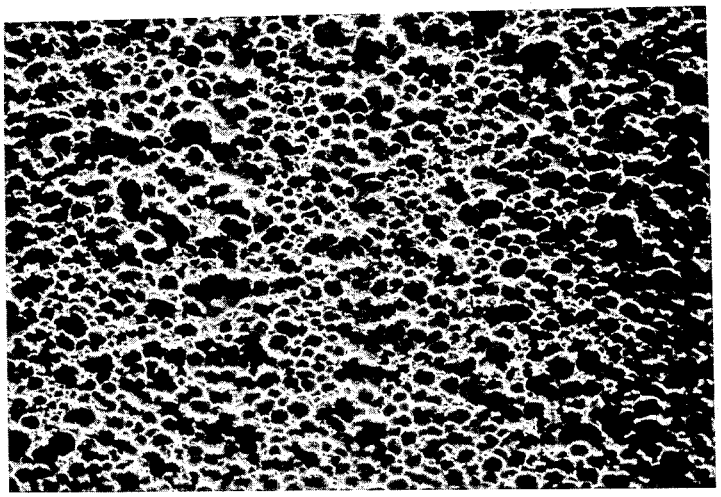
FIG. 1 is a photomicrograph of an electrochemically grained and anodized surface of a lithoplate magnified 1200 times made by a method of this invention.

The aluminum alloy for use in a method of this invention is predominantly aluminum but includes magnesium, silicon, iron and may include other elements as well. The percentile chemical composition limits of an alloy suitable for us in this invention are as follows:

| | |
|---|---|
| Cu | .20 max |
| Si | .055-.085 |
| Fe | .55-.75 |
| Mn | .20 max |
| Mg | .40-.70 |
| Zn | .25 max |
| Cr | .10 max |
| Ti | .05 max |
| V | .025 max |
| Other Elements: | |
| Each | .05 |
| Total | .15 |
| Al | Remainder |

An alloy having a composition within the foregoing limits is commonly referred to as a 5XXX type alloy according to the Aluminum Association standard designation system and has properties and characteristics similar to that designated as 5005. 5XXX alloys have been noted in patents as being suitable for making lithoplate but have not been used in commercial production heretofore. Patents such as Takenaka et al U.S. Pat. No. 4,168,167, for example, list 52S (former designation for alloy now known as 5052) as suitable for making lithoplate. Zelley U.S. Pat. No. 3,266,900 also includes 5052 alloy as suitable for. making a lithoplate of his invention. 5005 alloy has also been mentioned as being tried for graining by an electrochemical method in Example IV of Bednarz U.S. Pat. No. 4,377,447. It is noted, however, that in Bednarz' example, 5005 alloy is referred to as a roofing material and comments on the finished material are that the example indicated a nonuniform finish with gray grained portions visible to the naked eye. In contrast with other examples in the patent, it was not stated that the sample was further tested as lithoplate, and there was no indication that 5005 alloy was suitable for making lithoplate. Indeed, in consideration of the negative comment with respect to the nonuniform finish, one skilled in the art would believe that Bednarz teaches away from the use of 5005 alloy as suitable for making lithoplate.

Regardless of the suggestion in a relatively small number of patents that 5052 may be suitable for use in making lithoplate, it is not believed that it has been or is today in commercial use. As noted earlier, the predominant commercial Aluminum Association alloys for making a mechanically grained plate are 1100 and 3003 alloys, and 1050 alloy for making an electrochemically grained plate. As noted earlier, 1050 alloy is substantially pure aluminum and, as a consequence, sheet produced from this alloy has relatively low mechanical properties. As a matter of comparison, a 1050 alloy sheet in a typical H18 temper and having a typical lithoplate thickness of 0.012 inch has a typical ultimate strength of 23,000 psi, yield strength of 22,000 psi and elongation of 3%. In contrast, a 5XXX alloy suitable for use in making a lithoplate by a method of this invention has a typical ultimate strength of 26,000 psi, yield strength of 24,000 psi and elongation of 6%. It is evident that a lithoplate produced by a method of this invention is substantially stronger than a lithoplate made from 1050 alloy.

It is known that 5005 alloy is suitable for rolling into sheets to receive an anodized finish, but it is also known that when DC casting an ingot of 5005, a cast structure may develop which may later cause streaking in an anodized coating applied to sheet rolled from the ingot. As molten 5005 alloy solidifies in an ingot mold, it may assume two completely different structures with one being in the interior of the ingot and the other near the exterior. This combination of contrasting structures is referred to as a "pine tree" structure because of the irregular line of separation between the two structures and may cause streaking if, in scalping the ingot prior to rolling, alternating bands of the two structures are exposed on the scalped surface. The rate of cooling as the metal solidifies is at least one factor in determining which and to what extent the interior or exterior will be formed. Japanese Patent No. 83,026,421 discusses the "pine tree" structure and procedures to be used in controlling its formation for an alloy of a 5XXX type having a composition similar to 5005. The structure occurs according to the change in an Al-Fe intermetallic compound as it crystallizes into different Al-Fe phases. It is proposed in the patent that by controlling the cooling rate, the composition limits of Fe and Si, and the ratio of Fe to Si, an ingot can be cast which has predominantly either an exterior or interior cast structure, and by selection of an appropriate depth of scalping, the structure of the metal on the scalped surface will be substantially uniform.

For purposes of this invention, it is preferred that casting of the ingot be controlled to produce a structure referred to as the interior structure in the Japanese '421 patent. Such a structure is produced by maintaining the Fe and Si within composition limits which will provide a suitable Fe/Si ratio. In addition to controlling the Fe and Si content and the Fe/Si ratio thereby, other aspects of casting and preparation of the ingot prior to rolling are important for purposes of this invention. These other aspects are the use of a proper grain refiner when DC casting an ingot, control of casting conditions employing appropriate molten metal treatment practices, i.e., fluxing and filtration, to remove nonmetallic inclusions, using a proper casting speed and maintenance of a suitable depth of molten metal while casting, controlling the temperature of casting the ingot, scalping the ingot a suitable depth, and controlling the homogenizing and preheat temperatures employed prior to hot rolling the ingot. All of the foregoing variables in casting and preparing an ingot for hot rolling are important in producing a satisfactory sheet to make lithoplate by a method of this invention and preferred parameters of each of these variables will now be discussed.

A suitable grain refiner for use in a process of this invention when DC casting an ingot is an Al-Ti-B alloy commercially available in a rod or waffle form which is added to the molten metal prior to casting the ingot. Preferably, it is added in rod form to the molten metal stream as it flows from the bath to the casting unit. The ratio of Ti to B in this grain refining alloy can be from 3:1 to 50:1 with the preferred ratio being 25:1. The amount of added Ti should be no greater than 0.015% and the maximum Ti in the cast ingot should not exceed 0.05%. Grain refining alloys having other metallic elements selected from Group VB in the periodic table of elements can be used as alternates such as Nb or Ta, for example, but these alternative alloys are generally not available commercially. It is noted that the foregoing requirement for addition of a grain refiner is with respect to DC casting an ingot. An alternative casting procedure may enable making an ingot having a suitable grain and microstructure without having to add a grain refiner.

Removal of undesirable nonmetallic inclusions such as oxides, carbides, etc., in the molten metal is also important in a process of this invention to prevent such nonmetallic inclusions from being cast into the ingot. Suitable methods for removing nonmetallic inclusions are known in the art, such as fluxing the molten bath with an active gas such as chlorine, and/or passing the molten metal through filters prior to casting, for example.

The rate at which the ingot should be cast is that which produces a preferred denrite cell size and constituent type. It is desirable to cast the ingot in the range of 2–3 inches/minute. Maintaining a controlled depth of molten metal above the solidified metal while casting is also important. This depth should be maintained within a range of 2–½ to 3–½ inches from the point where solidification of the molten metal in the mold begins to the exit end of the mold.

The remaining factor to be controlled with respect to casting the ingot is the temperature. It should be cast at a relatively high incoming temperature; that is, 1310°±20° F.

After the ingot has been cast as just described, it should be scalped preliminary to hot rolling. The depth of scalp may vary but should be of sufficient depth to remove the zone of metal, generally referred to as the disturbed zone, which includes coarse dendrite cells and "pine tree" structure, for example. For a typical DC cast ingot, the scalp is typically ¾ inch/side.

Preferably, the ingot is homogenized at a relatively high temperature to assist in developing a fine uniform microstructure in order to develop a fine uniform surface on the sheet. The homogenization temperature and time should be 1130°± 20° F. for a time to insure homogenization. such as approximately 9 hours, for example. The ingot should then be cooled to a temperature of 905° F. or less at a rate ≦68° F/hour. Below 905° F, the cooling rate is not critical and the ingot may be allowed to cool to room temperature if desired.

Preheating of the ingot to bring it to the proper rolling temperature is necessary if the ingot is allowed to cool below the rolling temperature following homogenization. The rolling temperature affects the texture of the finished sheet and should be relatively low. If the ingot has cooled, the initial set temperature should be approximately 1076° F. to insure that it is completely heated, and thereafter the ingot should be allowed to cool to an initial rolling temperature of 860°±30° F. and maintained at that temperature for one hour. The holding temperature need be only that necessary to uniformly heat the ingot.

All of the foregoing steps in a method of this invention relate to casting and preparation of the ingot. Each of the foregoing steps is related to metallurgical control of the ingot to be used in rolling a 5XXX sheet which will respond favorably to graining and application of an anodized finish; that is, having a uniform grained surface which is substantially free from streaks or other defects attributable to metalklurgical flaws. The ingot is hot rolled and then cold rolled to final gauge and can be used in the as-rolled condition.

Proper concern or care in making and preparing the ingot will not alone insure production of a sheet that is suitable for making lithoplate. Hot rolling and cold rolling practices also affect sheet characteristics which are important in lithoplate quality. For example, rolled-in dirt or oxides picked up from rolls may later affect electrochemical graining and cause streaks in the anodized coating. The sheet should also be within appropriate thickness, flatness and width tolerances, and rolling practices directly affect these characteristics as well as affecting the mechanical properties of the finished sheet. Rolling practices employed heretofore in making sheet having a lithoplate surface quality are suitable for use in a process of this invention. It is understood that such practices may require some modification to develop the desired mechanical properties, degree of flatness, etc., for a 5005 type alloy.

Figure 2:
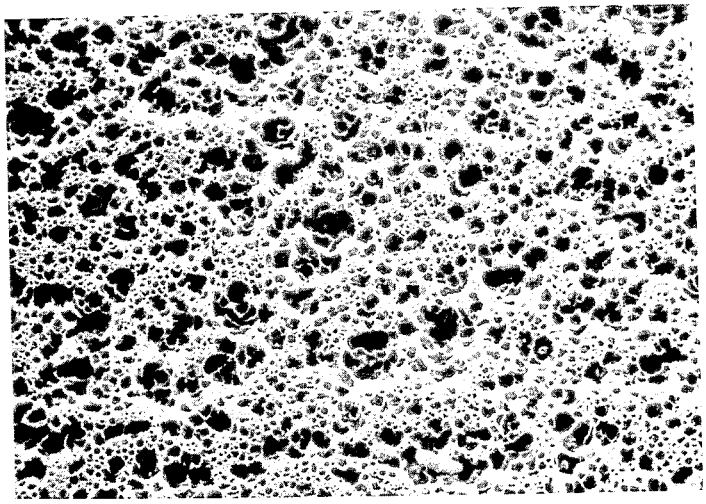
FIG. 2 is a photomicrograph of the surface of an alloy 1050 lithoplate magnified 1200 times which was electrochemically processed and anodized in an identical manner with that shown in FIG. 1.

After the sheet has been fabricated as just discussed, at least one side is grained by either a mechanical or electrochemical method. A workpiece made by a method of this invention is suitable for graining either mechanically or electrochemically. To illustrate the superiority of a chemically grained workpiece of this invention over an alloy 1050 sheet grained by the same process, reference is made to FIGS. 1 and 2. FIG. 1 is a photomicrograph of a chemically grained sheet produced by a method of this invention, and FIG. 2 is a photomicrograph of an alloy 1050 sheet grained by the identical process. Both pieces were grained by immersion in an electrolytic acid bath and were then processed and anodized using practices and procedures which are known to those skilled in the art. It is apparent that the craters on the sample produced by a method of this invention shown in FIG. 1 are more uniform in size and more evenly distributed over the surface than those shown on the sample shown in FIG. 2. Uniformity in size and evenness of distribution of craters is the desired goal in producing a grained surface. It is noted that FIGS. 1 and 2 are not representative with respect to the color or degree of lightness of the two samples. The fact that the sample of the sheet made by a process of this invention shown in FIG. 1 appears darker is attributable to differences in development of the photographs. In comparing the actual samples, that shown in FIG. 1 is actually lighter in color than that shown in FIG. 2.

The superior uniformity of size and evenness of distribution of craters on a sheet produced by a process of this invention is surprising and unexpected. As noted earlier, Bednarz U.S. Pat. No. 4,377,447 reported that 5005 alloy does not respond favorably to an electrochemical method of graining.

It is also important and advantageous that a lithoplate made by a process of this invention can be mechanically grained as well as chemically grained. A sheet made by a process of this invention produces a mechanically grained surface that is lighter in color than that of a 3003 alloy sheet. A lithoplate made by a process of this invention has comparable or slightly better mechanical While the invention has been described in terms of preferred embodiments, the claims appended hereto are intended to encompass all embodiments which fall within the spirit of the invention.

What is claimed is:

1. A method for producing lithoplate, comprising:

providing a molten aluminum alloy consisting essentially of the following elements in percent by weight: Cu-0 to 0.20%; Si - 0.055 to 0.085%; Fe - 0.55 to 0.75%; Mn - 0 to 0.20%; Mg - 0.40 to 0.70%; Zn - 0 to 0.25%; Cr - 0 to 0.10%; Ti - 0 to 0.05% (when cast); V - 0 to 0.025%; other elements - 0 to 0.05%, not to exceed 0.15% total; and the remainder Al;

casting the alloy into a mold to form an ingot;

homogenizing the ingot at a suitable temperature for a period of time suitable to ensure homogenization of the ingot;

hot rolling the ingot to produce a reroll stock;

cold rolling the reroll stock to a finished gauge workpiece; and graining at least one surface of the workpiece.

2. A method according to claim 1, further comprising providing an anodized finish to the grained workpiece.

3. A method according to claim 1, further comprising adding a grain refiner to the molten alloy.

4. A method according to claim 3, wherein the grain refiner comprises an element selected from Group VB of the periodic table of elements.

5. A method according to claim 1, wherein the ingot as cast has an interior crystalline structure and a disturbed exterior crystalline structure, the process further comprising scalping the ingot to a depth sufficient to remove substantially all of the exterior structure of cast metal.

6. A lithoplate having a grained surface, formed of a homogenized aluminum alloy of the 5XXX series, the lithoplate being anodized and substantially free of surface streaks.

7. The lithoplate of claim 6, further comprising a light sensitive resist coated on the grained surface.

8. The lithoplate of claim 6, wherein the alloy consists essentially of, in weight percent, about 0 to 0.20% Cu; about 0.055 to 0.085% Si; about 0.55 to 0.75% Fe; about 0 to 0.20% Mn; about 0.40 to 0.70% Mg; about 0 to 0.25% Zn; about 0 to 0.10% Cr; about 0 to 0.05% Ti; about 0 to 0.025% V; about 0 to 0.05% other elements not to exceed about 0.5% total; and the remainder Al.

9. A lithoplate having a grained surface coated with a light-sensitive resist, the improvement comprising the lithoplate having a composition consisting essentially of 0.20% max. Cu, 0.055–0.085% Si, 0.55–0.75% Fe, 0.20% max. Mn, 0.40–0.70% Mg, 0.25% max. Zn, 0.10% max. Cr, 0.05% max. Ti, 0.025% max. V, 0.05% max. each of other elements not to exceed 0.15% total, and the remainder Al.

* * * * *